United States Patent [19]

Hackney

[11] Patent Number: 4,535,825

[45] Date of Patent: Aug. 20, 1985

[54] SAIL BATTEN IMPROVEMENTS

[76] Inventor: John Hackney, P.O. Box 1146, Jensen Beach, Fla. 33457

[21] Appl. No.: 486,216

[22] Filed: Apr. 18, 1983

[51] Int. Cl.[3] ..... B63H 9/04

[52] U.S. Cl. ..... 114/103

[58] Field of Search ..... 114/39, 102, 103, 218, 114/43; 244/153 R; D21/88

[56] References Cited

U.S. PATENT DOCUMENTS

| | | | |
|---|---|---|---|
| 1,362,950 | 12/1920 | Ljungstrom | 114/103 |
| 3,026,121 | 3/1962 | Ellam | 114/43 |
| 3,557,733 | 1/1971 | Mathieu | 114/39 |
| 3,570,791 | 3/1971 | Jackson | 244/153 R |
| 3,788,257 | 1/1974 | Miller | 114/39 |
| 4,064,821 | 12/1977 | Roberts | 114/39 |
| 4,186,680 | 2/1980 | Harpole | 114/103 |
| 4,335,669 | 6/1982 | Hackney | 114/103 |
| 4,426,800 | 1/1984 | Brown | 244/153 R |

FOREIGN PATENT DOCUMENTS

| | | | |
|---|---|---|---|
| 138139 | 11/1952 | Sweden | 114/103 |
| 1316659 | 5/1973 | United Kingdom | 114/102 |

*Primary Examiner*—Sherman D. Basinger

*Attorney, Agent, or Firm*—Carroll F. Palmer

[57] ABSTRACT

Sail battens for full battened sails are provided on their fore ends with luff caps that have an angled leading edge. The improved battens are used in sail batten pockets that do not extend perpendicular to the sail luff to prevent the batten fore end from wearing holes in the batten pockets as occurs with battens having square ends when used in such angled batten pockets.

13 Claims, 7 Drawing Figures

SAIL BATTEN IMPROVEMENTS

BACKGROUND OF THE INVENTION

1. Field of the Invention

This invention relates broadly to improvements in battens for sails of boats and other sailcraft. More particularly, it concerns novel forms of sail batten luff caps, improved sail battens comprising such caps and batten-sail combinations equipped with the improved sail battens.

2. Description of the Prior Art

As explained in my previous patent U.S. Pat. No. 4,335,669, the disclosure of which is incorporated herein by reference, battens are extensively used with sails for sailcraft, e.g., sailboats, iceboats, wind propelled scooters, sail-boards, etc., to support and/or shape the sails. The sails with which battens are used include lugsails, lateen sails, square-rigged sails, jib-headed (Marconi rig) sails and gaff rig sails. This invention pertains primarily to battens for jib-headed sails.

Jib-headed sails may be divided into several classes with respect to battens, namely, unbattened sails, partial batten sails and full battened sails. The battens serve to support roach (excess cloth) formed into the leech of the sail. Hence, sails, e.g., those used on cruising boats, made without roach do not need battens so are unbattened.

In racing sailboats, iceboats and other racing sailcraft, high performance is demanded of the sails. The sails for such sailcraft are usually made with a high degree of roach and require battens to provide proper leech shape. The partial batten type sails use a plurality of battens that are carried in pockets extending forward from the leech only a minor length of their chords of the sails. In contrast, full battened sails use a plurality of battens carried in pockets that extend all the way from the leech to the luff of the sail at spaced intervals between the foot and the head of the sail. The full type battens are longer than their respective pockets and by compressing such batten in their pockets between the luff and the leech, the battens can be caused to bow. The greater the compression, the greater the bow creating a larger draft in the sail. Hence, compression on the full type (FT) battens is used by the sailcraft operator to control sail shape to obtain maximum performance from the sail for the prevailing wind conditions.

Compression on the FT battens drives their fore ends into the leading edge of the batten pocket and into the sail luff. Consequently, the sail cloth in the pocket and the luff is subjected to excessive wear, often resulting in the batten producing a hole in the sail at the luff. Such damage to the sail is particularly severe where the fore ends of the FT battens are square. In order to reduce this form of sail damage, FT battens have been provided with rounded fore ends and/or rounded luff caps. Also, rigid cups made of plastic or the like have been riveted over the fore ends of the batten pockets. However, these modifications to FT batten arrangements have not fully eliminated the indicated batten compression damage to luff portions of sails in full battened sails for sailcraft.

OBJECTS

A principal object of the present invention is the provision of new improvements in sail battens. Further objects include the provision of:

(1) New forms of luff caps for battens.

(2) Improved forms of FT sail battens designed to mitigate compression damage to the luff portions of sails using FT battens.

(3) Novel sail batten pocket and sail batten combinations.

(4) Improved forms of full battened sails.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished in accordance with the present invention by the provision of sail battens provided at their fore ends with improved forms of luff caps. Basically, the new luff caps have a fore portion with a leading edge that for the majority of its length defines a straight line which will form an acute angle with the longitudinal axis of the batten to which they are fixed.

In their preferred embodiments, the means for fixing the new luff caps to battens is a slot in the aft portion of a size and shape to tightly envelope the fore ends of the battens, but other fixing means may be used. The fore portions of the new luff caps may be solid or, alternatively, they may be made with transverse openings to make them lighter.

Additionally, the invention objects are accomplished by provision of (a) new sail battens having the new luff caps as described fixed to their fore ends, (b) combinations of sail pockets and such new FT sail battens and (c) sails equipped with such sail pocket-batten combinations.

BRIEF DESCRIPTION OF THE DRAWINGS

A more detailed understanding of the new devices of the invention and their use may be had by reference to the accompanying drawings, in which.

DESCRIPTION OF THE PREFERRED EMBODIMENTS

Figure 1:
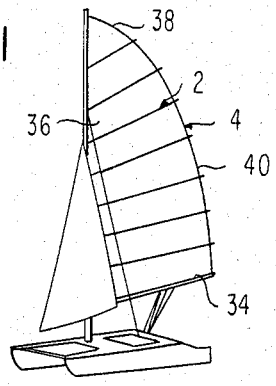
FIG. 1 is a schematic prospective view of a catamaran sailboat equipped with a mainsail containing new FT battens of the invention.
Figure 5:
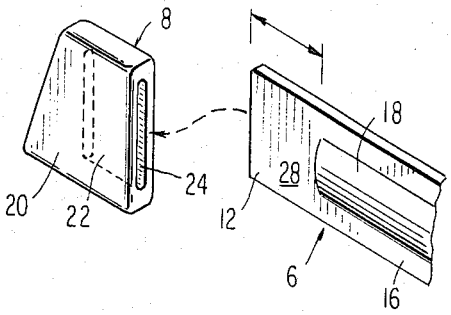
FIG. 5 is an exploded, fragmentary, isometric view of a luff cap and batten combination of the invention.
Figure 2:
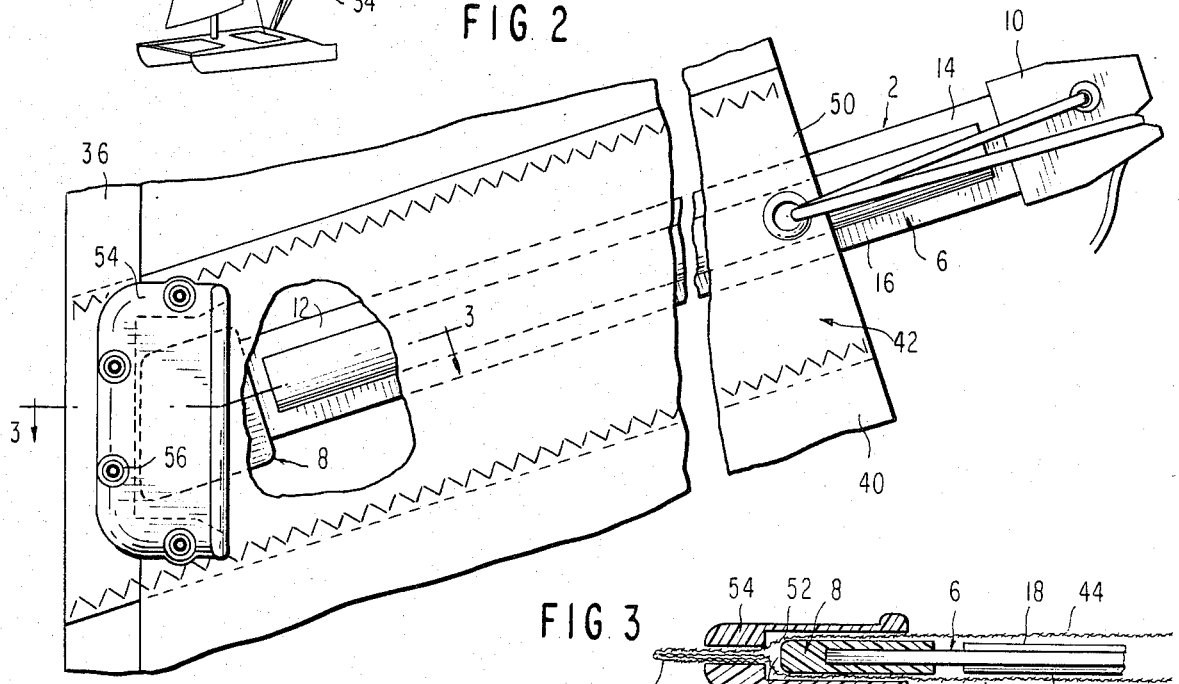
FIG. 2 is a fragmentary, lateral view of a FT batten and sail combination of the invention.
Figure 3:
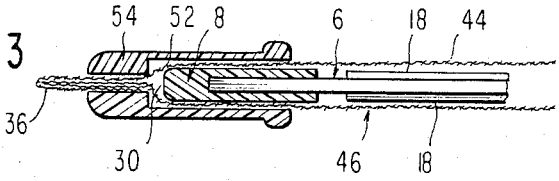
FIG. 3 is a fragmentary, sectional view taken on the line 3—3 of FIG. 2.
Figure 4:
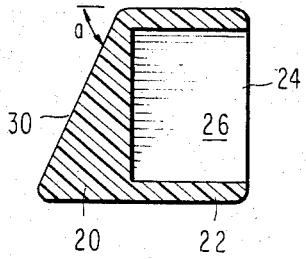
FIG. 4 is a lateral, sectional view of a new batten luff cap of the invention.

Referring in detail to the drawings, a sail batten device 2 of the invention for a full battened sail 4 comprises a batten 6, new type luff cap 8 and batten constraining member 10.

The batten 6 has a fore portion 12 and an aft portion 14 joined integrally with a central body portion 16. The batten 6 may include strengthening ribs 18 that may extend the full length of the batten or, as illustrated in the drawings, the ribs may stop short of the ends to leave the fore portion 12 and aft portion 14 free of the ribs 18. This latter arrangement simplifies the fixing of the luff cap 8 to the batten 6 as explained below.

The luff caps 8 comprise a fore portion 20 and an integral aft portion 22 that contains a slot 24 which serves as means for fixing the caps 8 to battens 6. As illustrated, the slot 24 has a simple rectangular cross-section to mate with the unribbed, fore portion 12 of batten 6. Cement, adhesive, or the like may be applied between the slot inner-surface 26 and the outer-surface 28 of batten portion 12 to ensure permanent connection between the parts.

If the battens 6 have ribs (not shown) that extend the entire length of thereof, the slots (not shown) in the luff caps would be shaped as a female opening to sungly receive the batten fore portion. Also, other means for fixing the caps to the battens may be used, e.g., luff caps (not shown) with solid aft portions can be butt welded to the front edges of the battens.

The cap fore portion 20 has a leading edge 30 that for the majority of its length defines a straight line which forms an acute angle "a" with the longitudinal axis of slot 24 and, in turn, with the longitudinal axis of the batten 6.

Figure 7:
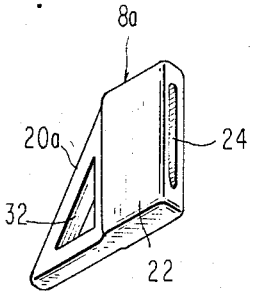
FIG. 7 is an isometric view of a modified form of luff cap of the invention.

The fore portion 20 of luff caps 8 consist of a solid section in the shape of a right triangle. In the modified form of luff caps **8*a* of FIG. 7, the fore portion 20*a* has a transverse opening 32 therethrough. This serves to lessen the cap weight without serious harm to the cap strength. The width of the fore portion 20*a* is also reduced relative to the width of the aft portion 22** also for weight reduction.

The full battened sailcraft sail 4 has a foot 34, luff 36, head 38 and leech 40. A series of batten pockets 42 are spaced apart along the sail 4 between the foot 34 and head 38. As seen in FIG. 1, each pocket 42 extends substantially the full distance between the luff 36 and leech 40 at the position in the sail where each pocket is located. In the construction of the full battened type (FBT) sails, such as sail 4, the battens are not all parallel nor is the longitudinal axes of the pockets 42 perpendicular to the sail luff 36. Hence, the longitudinal axis of at least some of the batten pockets 42 define, relative to the sail luff 36, a different acute angle "a" from that of other of the pockets in the sail 4.

The construction of the pockets 42 is not critical to the present invention, i.e., the new batten devices 2 are intended for use with sails and sail pockets of any conventional style of FBT sails. Typically, batten pockets of such sails comprise a layer 44 of sailcloth fixed to the sailcloth 46 of the sail 4 by stitching 48. Generally, such sails are made of a series of cloth panels with the pockets 42 located at the junctions of the panels.

The batten constraining device 10 shown is of the type described and claimed in U.S. Pat. No. 4,335,669, but any other type of constraining device for battens may be used in practicing the present invention.

The aft ends 50 of the pockets 42 are open and terminate at the sail leech 40. The fore ends 52 are closed and are adjacent the sail luff 36 and substantially parallel thereto. When installed properly in a sail pocket 42, the leading edges 30 of the new batten caps 8 bear against the fore ends 52 of the pockets 42 with these two parts in line-to-line contact.

In preferred forms of sail combinations of the invention, rigid caps 54 are fixed, e.g., by rivets 56, adjacent the sail luff 36 about the closed fore ends 52 of the pockets 42 to serve as bearing members for the luff caps 8 of the battens 6 carried in the pockets 42. The caps may be molded of rigid plastic, stamped from metal or made in any other suitable manner.

Figure 6:
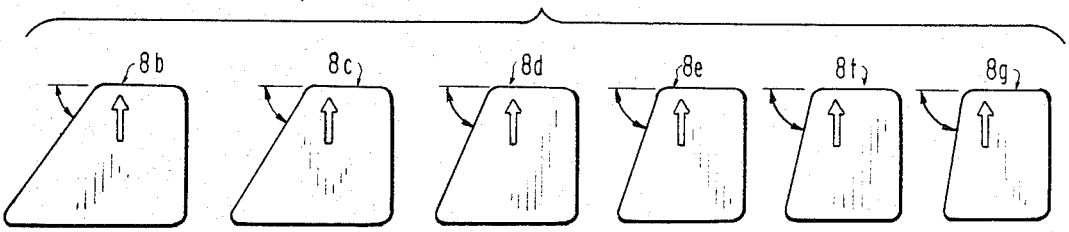
FIG. 6 is a lateral view of a set of luff caps for a set of battens to used in a full battened sail such as shown in FIG. 1.

Since, a plurality of batten pockets in a sail will have longitudinal axes extending at different acute angles relative to the sail luff, a set of the new batten caps will be formed with various leading edge angles. FIG. 6 illustrates a set of luff caps for a typical sail. Cap **8*b* has a leading edge angle of 50°, while caps 8*c*, 8*d*, 8*e*, 8*f* and 8*g* have leading edge angles of 56°, 64°, 71°, 76° and 82° respectively. A typical set of caps may consist of, for example, one each of 8*b*, 8*c*, 8*d* and 8*f* plus two each of 8*e* and 8*g***.

The new luff caps are preferably made by injection molding from rigid plastic, e.g., nylon, ABS, etc., but they may also be made of any other suitable material, e.g., metal, wood, etc., by any desired fabrication method.

The embodiments of the invention in which an exclusive property or privilege is claimed are defined as follows:

1. A batten for a full battened sail provided on its fore end with a luff cap that comprises:

a fore portion and an integral aft portion, means on said aft portion to attach said luff cap to said batten, said fore portion having a leading edge that for the majority of its length defines a straight line which forms a single acute angle with the longitudinal axis of said batten.

2. The batten of claim 1 wherein said means to attach is a slot in said luff cap extending from said aft portion toward said fore portion of such size as to permit said fore end to snugly fit into the slot.

3. The batten of claim 1 wherein said fore portion consists of a solid section in the shape of a right triangle.

4. The batten of claim 1 wherein said fore portion consists of a section in the shape of a right triangle having a transverse opening therethrough.

5. A full battened sailcraft sail comprising:

a foot, a luff, a head and a leach, a series of sail batten pockets spaced apart along said sail between its foot and head, each pocket extending substantially the full distance between said luff and said leech, the longitudinal axis of at least some of said pockets defining relative to said luff a different acute angle from other of said pockets, open aft ends in said pockets at said leech, closed, straight fore ends in said pockets adjacent said luff that run substantially parallel to said luff, and battens in said pockets, said battens having on their fore ends luff caps that comprise:

a fore portion and an integral aft portion, means on said aft portion attaching said luff cap to said batten, said fore portion having a leading edge that for the majority of its length defines a straight line which forms a single acute angle with the longitudinal axis of said batten, said leading edges of said luff caps of said battens being positioned in said pockets to run substantially parallel to said sail luff.

6. The sail of claim 5 that is a jib-headed sail.

7. The sail of claim 6 wherein said sail leech carries means to compress said battens into said pockets.

8. The sail of claim 5 having rigid cups fixed adjacent said sail luff about said closed fore ends of said pockets to serve as bearing members for said luff caps of the battens carried in said pockets.

9. A luff cap for a batten of a full battened sail comprising:

a fore portion and a integral aft portion, means on said aft portion to attach said luff cap to a batten, said fore portion having a leading edge that for the majority of its length defines a straight line which will form a single acute angle with the longitudinal axis of said batten to which said luff cap is attached.

10. The luff cap of claim 9 wherein said means to attach is a slot in said luff cap extending from said aft portion toward said fore portion of such size as to permit said batten to snugly fit into said slot.

11. The luff cap of claim 9 wherein said fore portion consists of a solid section in the shape of a right triangle.

12. The luff cap of claim 9 wherein said fore portion consists of a section in the shape of a right triangle having a transverse opening therethrough.

13. As an article of manufacture, the combination of a multiplicity of luff caps as defined in claim 9 wherein at least some of said caps of said combination have said acute angle different from said acute angle of other said caps of said combination.

* * * * *